US005915450A

United States Patent [19]

Aufderheide et al.

[11] Patent Number: 5,915,450

[45] Date of Patent: Jun. 29, 1999

[54] RISER SLEEVES FOR CUSTOM SIZING AND FIRM GRIPPING

[75] Inventors: Ronald C. Aufderheide, Dublin; David M. Gilson, Columbus, both of Ohio; John L. Perrins, Guelph, Canada

[73] Assignee: Ashland Inc., Columbus, Ohio

[21] Appl. No.: 08/872,382

[22] Filed: Jun. 13, 1997

[51] Int. Cl.[6] ..... B22C 9/08; B22D 27/04

[52] U.S. Cl. ..... 164/53; 164/359; 164/122

[58] Field of Search ..... 164/359, 360, 164/229, 53, 122, 125; 249/197, 198

[56] References Cited

U.S. PATENT DOCUMENTS

| | | | |
|---|---|---|---|
| 4,131,152 | 12/1978 | Ruddle et al. | 249/106 |
| 4,423,762 | 1/1984 | Trinkl et al. | 164/37 |
| 4,526,219 | 7/1985 | Dunnavant | 164/16 |
| 4,574,869 | 3/1986 | Trinkle et al. | 164/360 |
| 4,665,966 | 5/1987 | Neu et al. | 164/359 |
| 5,299,625 | 4/1994 | Miki et al. | 249/197 |

OTHER PUBLICATIONS

Transactions of the American Foundrymens Society—vol. 86 p. 431; vol. 72 p. 433—Riser Sleeves, '78 & '74.

Thomas Register via Internet , Thomas Publishing Company—Classification Search–Foundry Supplies & Equipment, 1998.

*Primary Examiner*—Patrick Ryan
*Assistant Examiner*—Anjan Dey
*Attorney, Agent, or Firm*—David L. Hedden

[57] ABSTRACT

This invention relates to riser sleeves which contain markings and concentric grooves. The markings are used to as a guide so one can customize the size of the sleeves and the concentric grooves are used to help hold the sleeve in place when it is placed in the mold where it surrounds the riser. The invention also relates to the use of the riser sleeves in the making of metal castings.

7 Claims, 3 Drawing Sheets

Fig. 3
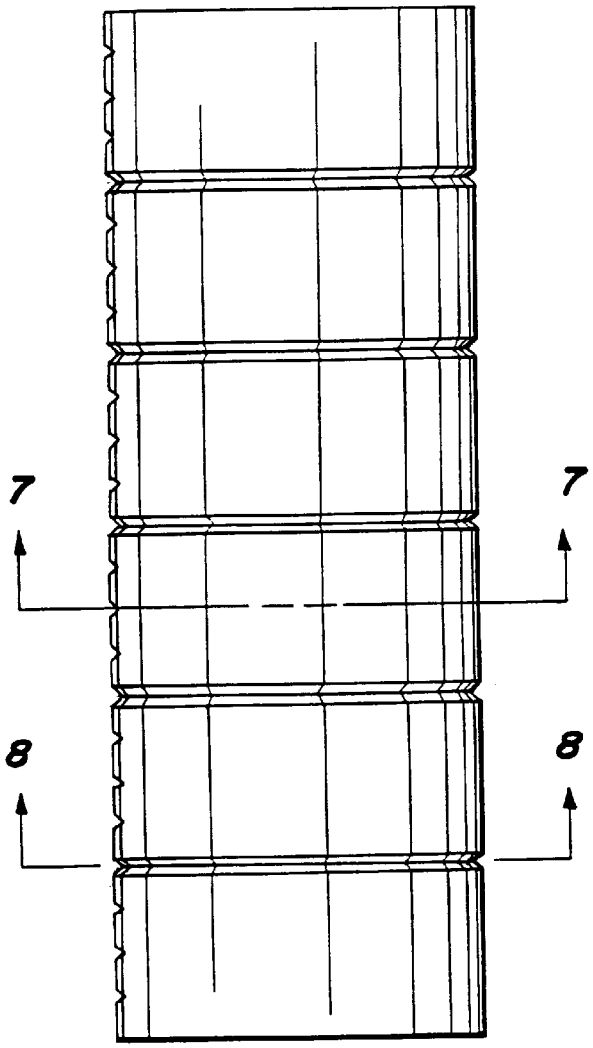
Fig. 4
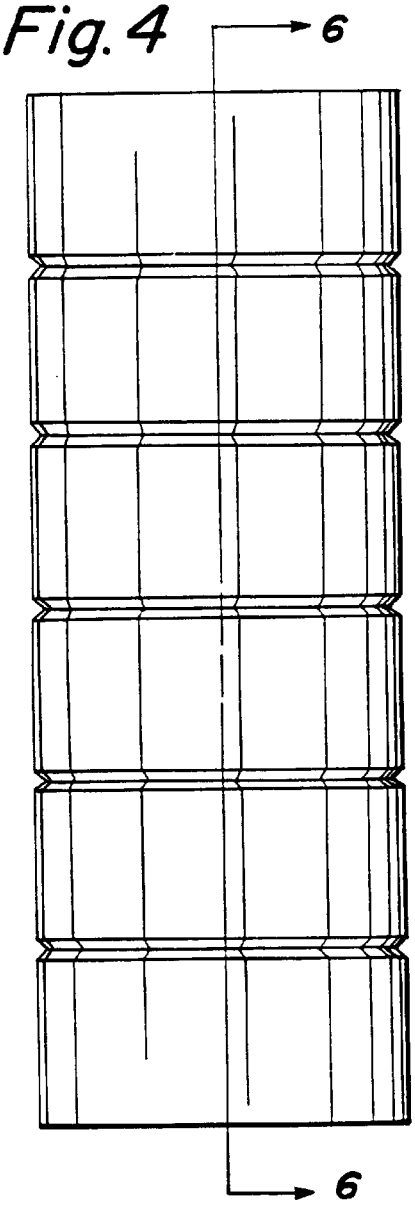
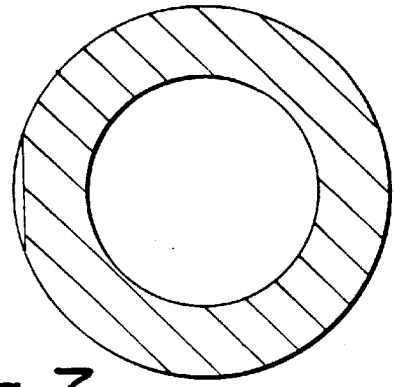
Fig. 7
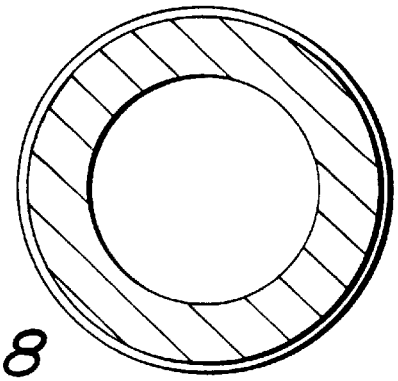
Fig. 8

RISER SLEEVES FOR CUSTOM SIZING AND FIRM GRIPPING

FIELD OF INVENTION

This invention relates to riser sleeves which contain markings and concentric grooves. The markings are used to as a guide so one can customize the size of the sleeves and the concentric grooves are used to help hold the sleeve in place when it is placed in the mold where it surrounds the riser. The invention also relates to the use of the riser sleeves in the making of metal castings.

BACKGROUND OF THE INVENTION

A casting assembly consists of a pouring cup, a gating system (including downsprues, choke, and runner), risers, sleeves, molds, cores, and other components. To produce a metal casting, metal is poured into the pouring cup of the casting assembly and passes through the gating system to the mold and/or core assembly where it cools and solidifies. The metal part is then removed by separating it from the core and/or mold assembly.

Risers or feeders are reservoirs which contain excess molten metal which is needed to compensate for contractions or voids of metal which occur during the casting process. Metal from the riser fills such voids in the casting when metal from the casting contracts. Thus the metal from the riser remains in a liquid state for a longer period of time, thereby providing metal to the casting as it cools and solidifies.

Riser sleeves are used to surround or encapsulate the riser of the casting assembly in order to keep the molten metal in the riser hot and maintain it in the liquid state. In order to serve their function, riser sleeves must have exothermic and/or insulating properties. Predominately exothermic sleeves operate by liberating heat which satisfies some or all of the specific heat requirements of the riser and limits the temperature loss of the molten metal in the riser, thereby keeping the metal hotter and liquid longer. Insulating sleeves, on the other hand, maintain the temperature of the molten metal in the riser by insulating it from the surrounding mold assembly.

Typical materials used to make sleeves are aluminum, oxidizing agents, fibers, fillers and refractory materials, particularly alumina, aluminosilicate, and aluminosilicate in the form of hollow aluminosilicate spheres. The type and amount of materials in the sleeve mix depends upon the properties of the sleeves which are to be made.

Three basic processes are used for the production of sleeves, "ramming", "vacuuming", and "blowing or shooting". Ramming and blowing are basically methods of compacting a sleeve composition and binder into a sleeve shape. Ramming consists of packing a sleeve mix (sleeve composition and binder) into a sleeve pattern made of wood, plastic, and/or metal. Vacuuming consists of applying a vacuum to an aqueous slurry of a refractory and/or fibers and suctioning off excess water to form a sleeve. Blowing consists of forcing the sand mix into the tooling with air under pressure.

More recently, it is known to prepare riser sleeves by the cold-box and no-bake fabrication process. In these processes, the sleeves are made by mixing a sleeve mix with a chemically reactive binder. The sleeve mix is shaped and cured with a curing catalyst which is reactive with the binder.

Sleeve compositions can be modified by the partial or complete replacement of the fibers with hollow aluminosilicate microspheres. See PCT publication WO 94/23865. This makes it possible to vary the insulating properties of the sleeves and reduces or eliminates the use of fibers which can create health and safety problems to workers making the sleeves and using the sleeves in the casting process.

Typically standard riser sleeves are mass produced by the supplier to fit the dimensions of the riser to be surrounded. However, in some special cases, sleeves with dimensions not readily available cannot be custom made and purchased for reasonable prices. In these cases, the user must somehow adapt a standard sleeve to meet his needs. This involves measuring the sleeve, marking the sleeve, and cutting the sleeve to the proper size. These operations result in extra time and waste.

SUMMARY OF THE INVENTION

This invention relates to riser sleeves for custom sizing comprising a sleeve having standard dimensions, where said sleeve is made of insulating and/or exothemic sleeve materials having markings and concentric grooves at periodic intervals. The markings are used for the efficient an effective custom sizing of the riser sleeve and the grooves help hold the sleeve in place. These features result in the saving of time, materials, and money.

The invention also relates to the use of the riser sleeves in the making of metal castings. Riser sleeves made by the cold-box or no-bake method are particularly adaptable for such markings and grooves because such sleeves have a smooth and consistent surface finish.

BRIEF DESCRIPTION EACH OF FIGURES

FIG. 3 is a side top view of the riser sleeve.

FIG. 4 is a rear view of the riser sleeve.

FIG. 7 is a transverse cross-section taken on the line 7—7 of FIG. 3.

FIG. 8 is a transverse cross-section taken on the line 8—8 of FIG. 3.

DEFINITIONS

Figure 1:
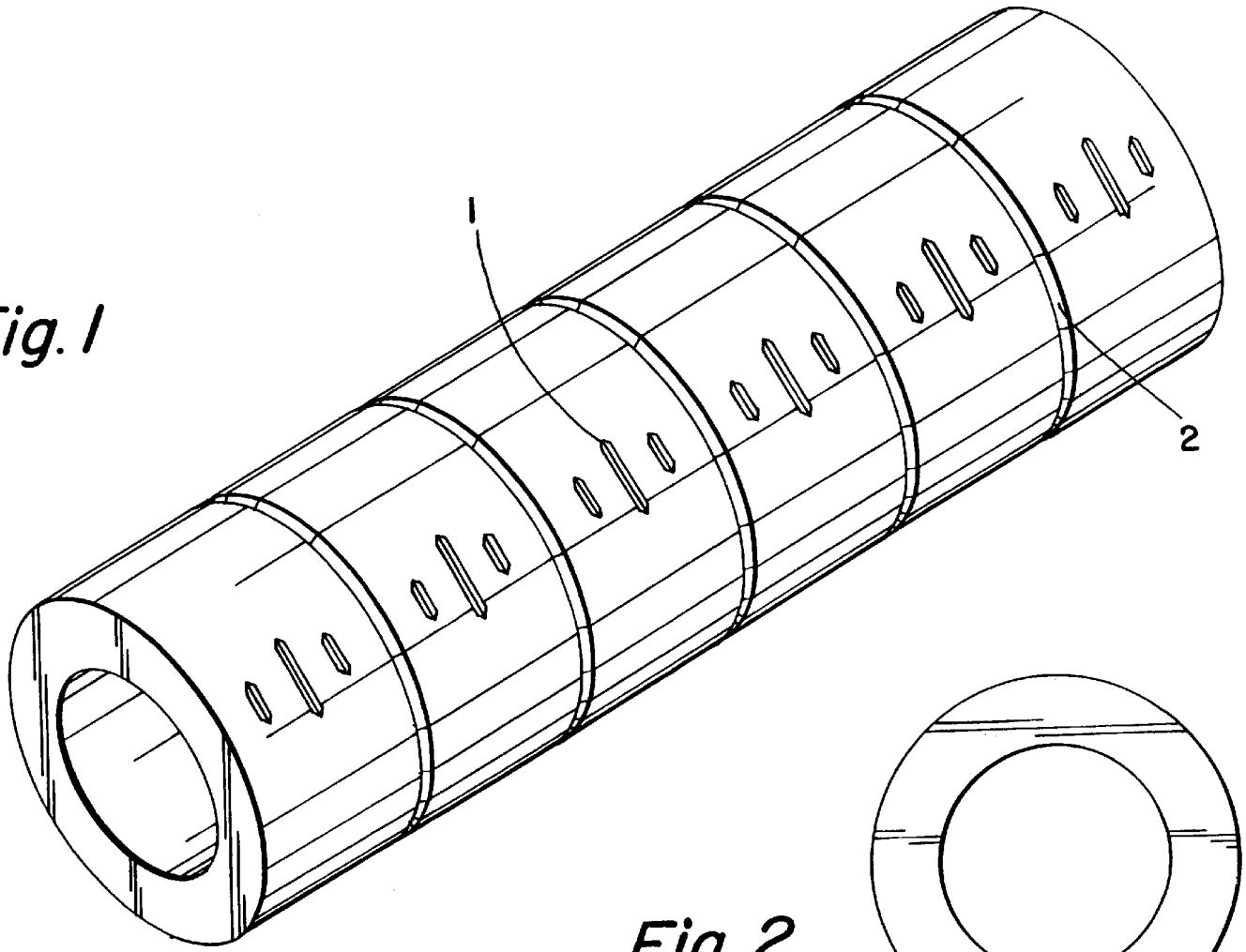
FIG. 1 is an isometric view of the riser sleeve.

The following definitions will be used for terms in the disclosure and claims:

Casting assembly—assembly of casting components such as pouring cup, downsprue, gating system (downsprue, runner, choke), molds, cores, risers, sleeves, etc. which are used to make a metal casting by pouring molten metal into the casting assembly where it flows to the mold cavity and cools to form a metal part.

Cold-box—mold or core making process which utilizes a vaporous catalyst to cure the mold or core.

EXACTCAST™ cold-box binder—a two part polyurethane-forming cold-box binder where the Part I is a phenolic resin similar to that described in U.S. Pat. No. 3,485,797. The resin is dissolved in a blend of aromatic, ester, and aliphatic solvents, and a silane. Part II is the polyisocyanate component comprises a polymethylene polyphenyl isocyanate, a solvent blend consisting primarily of aromatic solvents and a minor amount of aliphatic solvents, and a benchlife extender. The weight ratio of Part I to Part I is about 55:45.

Exothermic sleeve—a sleeve which has exothermic properties compared to the mold/core assembly into which it is inserted. The exothermic properties of the sleeve are generated by an oxidizable metal (typically aluminum metal) and an oxidizing agent which can react to generate heat.

Gating system—system through which metal is transported from the pouring cup to the mold and/or core assembly. Components of the gating system include the downsprue, runners, choke, etc.

Insulating sleeve—a sleeve having greater insulating properties than the mold/core assembly into which it is inserted. An insulating sleeve typically contains low density materials such as fibers and/or hollow microspheres.

No-bake—mold or core making process which utilizes a liquid catalyst to cure the mold or core, also known as cold-curing.

Riser—cavity connected to a mold or casting cavity of the casting assembly which acts as a reservoir for excess molten metal to prevent cavities in the casting as it contracts on solidification. Risers may be open or blind. Risers are also known as feeders or heads.

Sleeve—any moldable shape having exothermic and/or insulating properties made from a sleeve composition which covers, in whole or part, any component of the casting assembly such as the riser, runners, pouring cup, sprue, etc. or is used as part of the casting assembly. Sleeves can have a variety of shapes, e.g. cylinders, domes, cups, boards, cores.

Sleeve composition—any composition which is capable of providing a sleeve with exothermic and/or insulating properties. The sleeve composition will usually contain aluminum metal and/or aluminosilicate, particularly in the form of hollow aluminosilicate microspheres, or mixtures thereof. Depending upon the properties wanted, the sleeve composition may also contain alumina, refractories, an oxidizing agent, fluorides, fibers, and fillers.

Sleeve mix—a mixture comprising a sleeve composition and a chemical binder.

W/mL K.—a unit of thermal conductivity=watt/meter Kelvin.

DESCRIPTION OF THE INVENTION AND BEST MODE

Figure 2:
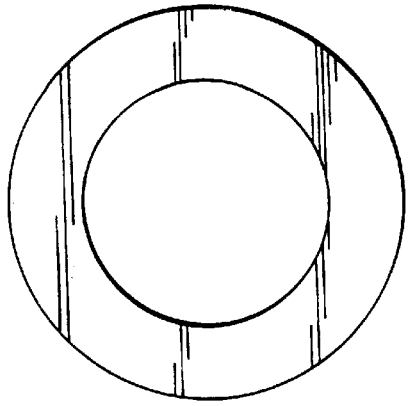
FIG. 2 is an end view of the riser sleeve.
Figure 5:
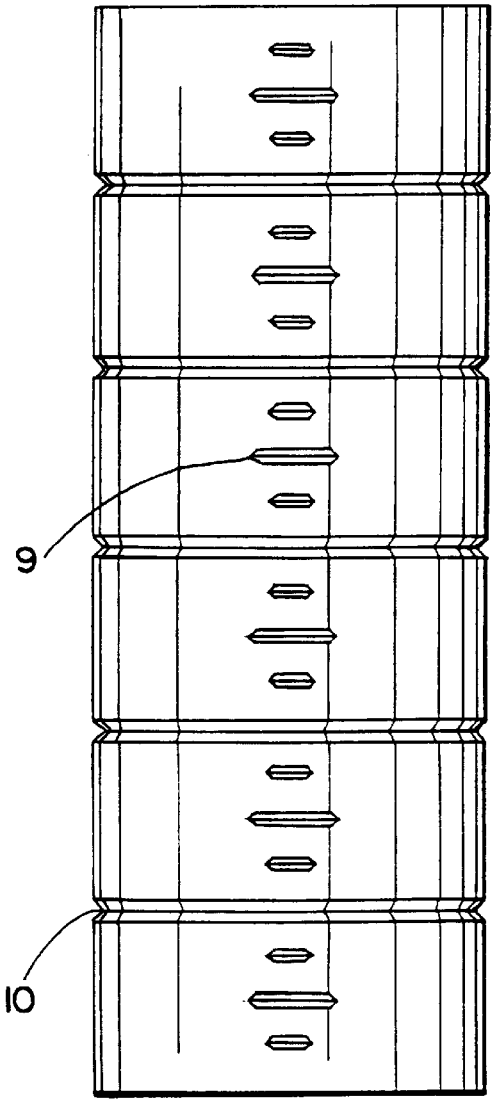
FIG. 5 is a front view of the riser sleeve.
Figure 6:
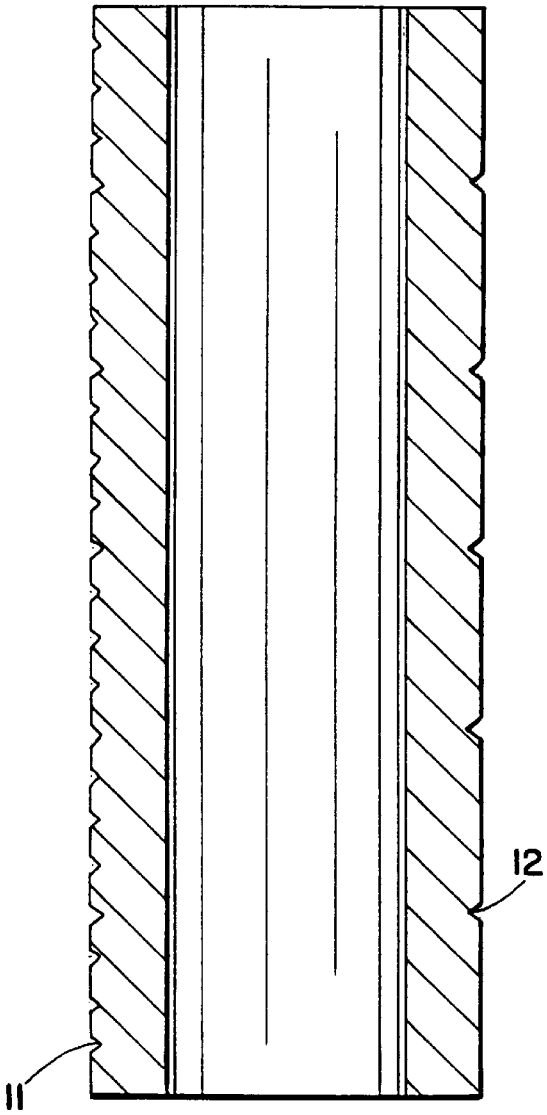
FIG. 6 is a longitudinal cross section taken on the line 6—6 of FIG. 4.

FIG. 1 is an isometric view of a riser sleeve showing measurement markings 1 and concentric grooves 2. FIG. 2 is an end view of the riser sleeve. FIG. 3 is a side top view of the riser sleeve showing measurement markings 3, concentric grooves 4, transverse line 7—7 on measurement marking 3, and transverse line 8—8 on groove 4. FIG. 4 is a rear view of the riser sleeve showing concentric grooves 5. FIG. 5 is a front view of the riser sleeve showing measurement markings 9, concentric grooves 10. FIG. 6 is a longitudinal cross section taken on the line 6—6 of FIG. 4 showing measurement markings 11, concentric grooves 12. FIG. 7 is a transverse cross-section taken on the line 7—7 of FIG. 3. FIG. 8 is a transverse cross-section taken on the line 8—8 of FIG. 3.

The sleeve mixes are prepared from (1) a sleeve composition, and (2) an effective amount of chemically reactive binder. The sleeve mix is shaped and cured by contacting the sleeve with an effective amount of a curing catalyst.

Any sleeve composition known in the art for making sleeves can be used to make the sleeves. The sleeve composition contains exothermic and/or insulating materials, typically inorganic. The exothermic and/or insulating materials typically are aluminum-containing materials, preferably selected from the group consisting of aluminum metal, aluminosilicate, alumina, and mixtures thereof, most preferably where the aluminosilicate is in the form of hollow microspheres.

The exothermic material is an oxidizable metal and an oxidizing agent capable of generating an exothermic reaction at the temperature where the metal can be poured. The oxidizable metal typically is aluminum, although magnesium and similar metals can also be used. The thermal properties of the exothermic sleeve is enhanced by the heat generated which reduces the temperature loss of the molten metal in the riser, thereby keeping it hotter and liquid longer.

The insulating material is typically alumina or aluminosilicate, preferably aluminosilicate in the form of hollow microspheres. The sleeves made with aluminosilicate hollow microspheres have low densities, low thermal conductivities, and excellent insulating properties. The thermal conductivity of the hollow aluminosilicate microspheres ranges from about 0.05 W/m.K to about 0.6 W/m.K at room temperature, more typically from about 0.1 W/m.K to about 0.5 W/m.K.

When aluminum metal is used as the oxidizable metal for the exothermic sleeve, it is typically used in the form of aluminum powder and/or aluminum granules. The oxidizing agent used for the exothermic sleeve includes iron oxide, manganese oxide, nitrate, potassium permanganate, etc. Oxides do not need to be present at stoichiometric levels to satisfy the metal aluminum fuel component since the riser sleeves and molds in which they are contained are permeable. Thus oxygen from the oxidizing agents is supplemented by atmospheric oxygen when the aluminum fuel is burned. Typically the weight ratio of aluminum to oxidizing agent is from about 10:1 to about 2:1, preferably about 5:1 to about 4:1.

As was mentioned before, the insulating properties of the sleeve are preferably provided by hollow aluminosilicate microspheres. The sleeves made with aluminosilicate hollow microspheres have low densities, low thermal conductivities, and excellent insulating properties.

Depending upon the degree of exothermic properties wanted in the sleeve, the amount of aluminum in the sleeve will range from 0 weight percent to 50 weight percent, typically 5 weight percent to 40 weight percent, based upon the weight of the sleeve composition.

Depending upon the degree of insulating properties wanted in the sleeve, the amount of hollow aluminosilicate microspheres, in the sleeve will range from 0 weight percent to 100 weight percent, typically 40 weight percent to 90 weight percent, based upon the weight of the sleeve composition. Since in most cases, both insulating and exothermic properties are needed in the sleeves, both aluminum metal and hollow aluminosilicate microspheres will be used in the sleeve.

The weight percent of alumina to silica (as $SiO_2$) in the hollow aluminosilicate microspheres can vary over wide ranges depending on the application, for instance from 25:75 to 75:25, typically 33:67 to 50:50, where said weight percent is based upon the total weight of the hollow microspheres. It is known from the literature that hollow aluminosilicate microspheres having a higher alumina content are better for making sleeves used in pouring metals such as iron and steel which have casting temperatures of 1300° C. to 1700° C. because hollow aluminosilicate microspheres having more alumina have higher melting points. Thus sleeves made with these hollow aluminosilicate microspheres will not degrade as easily at higher temperatures.

In addition, the sleeve composition may contain different fillers and additives, such as cryolite ($Na_3AlF_6$), potassium aluminum tetrafluoride, potassium aluminum hexafluoride.

The insulating and exothermic properties of the sleeve can be varied, but have thermal properties which are different in degree and/or kind than the mold assembly into which they will be used.

The density of the sleeve composition typically ranges from about 0.1 g/cc to about 0.9 g/cc, more typically from about 0.2 g/cc to about 0.8 g/cc . For exothermic sleeves, the density of the sleeve composition typically ranges from about 0.3 g/cc to about 0.9 g/cc, more typically from about 0.5 g/cc to about 0.8 g/cc. For insulating sleeves, the density of the sleeve composition typically ranges from about 0.1 g/cc to about 0.7 g/cc, more typically from about 0.3 g/cc to about 0.6 g/cc.

The binders that are mixed with the sleeve composition to form the sleeve mix are well know in the art. Any no-bake or cold-box binder, which will sufficiently hold the sleeve mix together in the shape of a sleeve and polymerize in the presence of a curing catalyst, will work. Examples of such binders are phenolic resins, phenolic urethane binders, furan binders, alkaline phenolic resole binders, and epoxy-acrylic binders among others. Particularly preferred are epoxy-acrylic and phenolic urethane binders known as EXACTCAST™ cold-box binders sold by Ashland Chemical Company. The phenolic urethane binders are described in U.S. Pat. Nos. 3,485,497 and 3,409,579, which are hereby incorporated into this disclosure by reference. These binders are based on a two part system, one part being a phenolic resin component and the other part being a polyisocyanate component. The epoxy-acrylic binders cured with sulfur dioxide in the presence of an oxidizing agent are described in U.S. Pat. No. 4,526,219 which is hereby incorporated into this disclosure by reference.

The amount of binder needed is an effective amount to maintain the shape of the sleeve and allow for effective curing, i.e. which will produce a sleeve which can be handled or self-supported after curing. An effective amount of binder is greater than about 4 weight percent, based upon the weight of the sleeve composition. Preferably the amount of binder ranges from about 5 weight percent to about 15 weight percent, more preferably from about 6 weight percent to about 12 weight percent.

Curing the sleeve by the no-bake process takes place by mixing a liquid curing catalyst with the sleeve mix (alternatively by mixing the liquid curing catalyst with the sleeve composition first), shaping the sleeve mix containing the catalyst, and allowing the sleeve shape to cure, typically at ambient temperature without the addition of heat. The preferred liquid curing catalyst is a tertiary amine. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

Curing the sleeve by the cold-box process takes place by blowing or ramming the sleeve mix into a pattern and contacting the sleeve with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins. Sulfur dioxide (in conjunction with an oxidizing agent) is used with an epoxy-acrylic resins.

See U.S. Pat. No. 4,526,219 which is hereby incorporated into this disclosure by reference. Carbon dioxide (see U.S. Pat. No. 4,985,489 which is hereby incorporated into this disclosure by reference) or methyl esters (see U.S. Pat. No. 4,750,716 which is hereby incorporated into this disclosure by reference) are used with alkaline phenolic resole resins. Carbon dioxide is also used with binders based on silicates. See U.S. Pat. No. 4,391,642 which is hereby incorporated into this disclosure by reference.

Preferably the binder is an EXACTCAST™ cold-box phenolic urethane binder cured by passing a tertiary amine gas, such a triethylamine, through the molded sleeve mix in the manner as described in U.S. Pat. No. 3,409,579, or the epoxy-acrylic binder cured with sulfur dioxide in the presence of an oxidizing agent as described in U.S. Pat. No. 4,526,219. Typical gassing times are from 0.5 to 3.0 seconds, preferably from 0.5 to 2.0 seconds. Purge times are from 1.0 to 60 seconds, preferably from 1.0 to 10 seconds.

The riser sleeves have a length of 2" to 20" in length, preferably 6" to 15"; an outer diameter of 2" to 18", preferably 2" to 14"; an inner diameter of 1" to 17", preferably 1" to 12"; markings spaced every 1/32" to 1/2", preferably every 1/16" to 3/16"; and concentric grooves spaced every 1" to 2". The depth of the concentric grooves is from 1/64" to 5/32, preferably 1/32" to 1/16". The markings are typically shallow notches made in the exterior of the sleeve wall.

EXAMPLE 1

A mixture consisting of aluminosilicate hollow ceramic microspheres (40 to 60 weight percent ) having a alumina content of from 30 to 40 weight percent, fine aluminum metal (20–40 weight percent), an oxidizing agent (5–10 weight percent), and an alkali aluminum hexafluoride (5–10 weight percent) is used as the sleeve composition and mixed with 8 to 10 weight percent of EXACTCAST™ cold-box binder to form a sleeve mix. The sleeve mix is blown into a pattern which will result in a riser sleeve having a length of 12" in length, an outer diameter of 3", an inner diameter of 2", notches spaced every 1/8" and concentric grooves spaced every 2".

The sleeve mix is gassed with triethylamine in nitrogen at 20 psi according to known methods described in U.S. Pat. No. 3,409,579. Gas time is 2.5 second, followed by purging with air at 60 psi for about 60.0 seconds. The riser sleeve is custom sized to 4". The riser sleeve is placed in a casting assembly where it surrounds a riser. Hot molten steel is poured into and around the casting assembly at a temperature of 1566° C. The riser sleeve rests firmly in place and does not move during the casting process.

We claim:

1. A riser sleeve for custom sizing for use in metal casting comprising:

a sleeve made of insulating and/or exothermic sleeve materials, said sleeve having markings and concentric grooves at intervals.

2. The riser sleeve of claim 1 wherein said riser sleeve is prepared by the cold-box or no-bake process.

3. The riser sleeve of claim 2 wherein the length of said riser sleeve is from 6" to 15".

4. The riser sleeve of claim 3 wherein the outer diameter of said riser sleeve is from 2" to 14" and the inner diameter of said riser sleeve is from 1" to 12".

5. The riser sleeve of claim 4 wherein said markings are equally spaced from 1/32" to 1/16" inches apart.

6. The riser sleeve of claim 5 wherein said grooves are equally spaced from 1" to 2" inches apart.

7. A process for casting a metal part comprising:

(a) inserting a riser sleeve of claim 1, 2, 3, 4, 5, or 6 into a casting assembly having a riser where said riser sleeve surrounds said riser;

(2) pouring metal, while in the liquid state, into said casting assembly;

(3) allowing said metal to cool and solidify; and (4) then separating the cast metal part from the casting assembly.

* * * * *